United States Patent [19]

Zeidler et al.

[11] 4,105,092

[45] Aug. 8, 1978

[54] LUBRICATING OIL SYSTEM

[75] Inventors: Günter Zeidler, Friedrichshafen; Christian Günther, Bermatingen, both of Fed. Rep. of Germany

[73] Assignee: Motoren- und Turbinen-Union Friedrichshafen GmbH, Fed. Rep. of Germany

[21] Appl. No.: 759,173

[22] Filed: Jan. 13, 1977

[30] Foreign Application Priority Data

Jan. 14, 1976 [DE] Fed. Rep. of Germany ..... 2601133

[51] Int. Cl.[2] ..... F01M 1/18; F01M 11/10

[52] U.S. Cl. ..... 184/6.4; 123/196 S; 184/103 R; 184/1 C

[58] Field of Search ..... 184/6.4, 6.3, 6.2, 6.24, 184/1 C, 6.28, 103 R, 105 R; 123/196 S, 198 D

[56] References Cited

U.S. PATENT DOCUMENTS

| | | | |
|---|---|---|---|
| 2,294,830 | 9/1942 | Brown | 123/196 S |
| 3,507,359 | 4/1970 | Warnock | 184/6.4 |
| 3,658,153 | 4/1972 | Berman | 184/6.3 |
| 3,782,501 | 1/1974 | Pagella | 184/6.4 |
| 3,876,037 | 4/1975 | Rath | 184/6.4 |
| 3,882,967 | 5/1975 | Gulla et al. | 184/103 R |
| 4,019,489 | 4/1977 | Cartmill | 123/198 D |

*Primary Examiner*—David H. Brown

*Attorney, Agent, or Firm*—Craig & Antonelli

[57] ABSTRACT

A drive mechanism lubricating system which includes a lubricating medium storage tank and an oil reservoir arranged at the drive mechanism for accommodating a predetermined quantity of lubricating medium. A first pump is arranged at the drive mechanism for constantly replenishing the oil reservoir with a supply of lubricating medium to maintain a predetermined quantity therein during an operation of the drive mechanism. A second pump, having a higher conveying power than the first pump, is arranged at the drive mechanism and operatively connects the oil reservoir with the storage tank for conveying excess lubricating medium from the reservoir to the storage tank. A monitoring construction is arranged in a delivery conduit of the second pump for monitoring the condition of the lubricating medium and providing an output signal upon a failure in a return flow of the lubricating medium, with the output signal from the monitoring construction triggering a warning device to indicate the failure in the lubricating system. An additional pump is provided for supplying lubricating medium from the reservoir to lubricating points of the drive mechanism with a monitoring construction being arranged in conduits from the additional pump to monitor the operative condition of the pump and provide a signal indicative of a failure of such pump.

24 Claims, 1 Drawing Figure

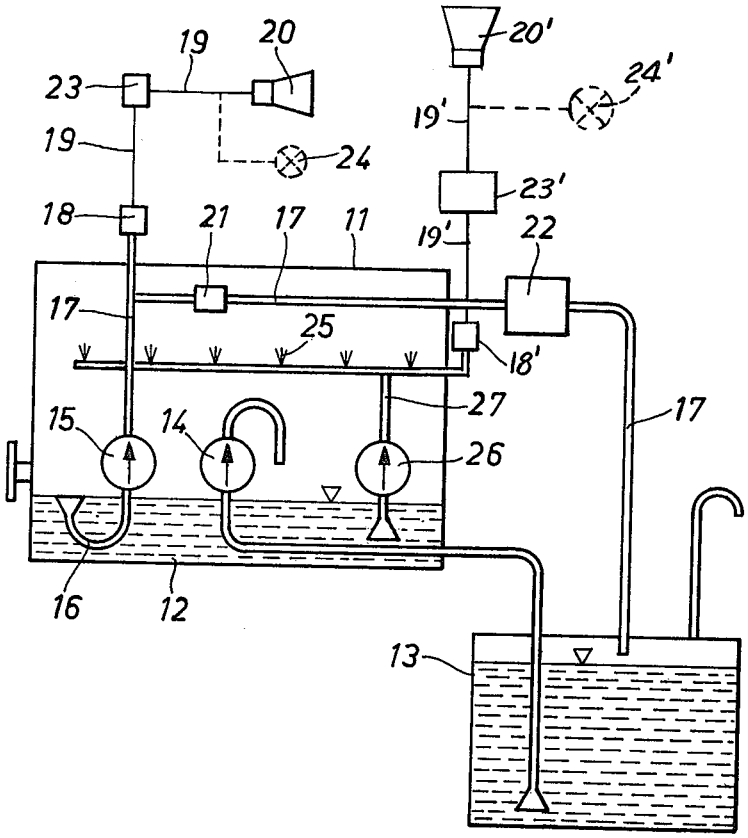
19
20
20'
23
24'
19'
19
24
23'
18
21
17
11
19'
22
17
25
18'
27
17
15
14
26
16
12
13

LUBRICATING OIL SYSTEM

The present invention relates to a lubricating system and, more particularly, to a lubricating system for supplying and monitoring the supply of a lubricating medium to a drive mechanism such as, for example, an internal combustion engine, with the lubricating medium being supplied from a storage tank.

In non-monitored operation of continuously operated drive mechanisms, i.e., operations which are not under a constant supervision by personnel, the lubricating medium consumed by a drive mechanism as, for example, an internal combustion engine, must be automatically constantly replenished for even a brief dry run of the internal combustion engine would result in a considerable damage to such engine.

In order to protect the internal combustion engine from damage due to insufficient lubrication, it has been proposed to monitor a pressure in a conduit system supplying a lubricating medium, for example, lubricating oil, to the lubricating points of the internal combustion engine and to shut down the internal combustion engine when a pressure in the supply conduit system falls below a predetermined minimum value.

In such proposed construction, an oil filter is connected to a lubricating oil conduit system in a by-pass branch with the quantity of lubricating oil flowing through the by-pass branch being determined by means of a throttle diaphragm arranged at the branching point of the by-pass conduit. However, such a construction results in a considerable safety risk for a continuously operable drive mechanism such as an internal combustion engine since, by virtue of the presence of the throttle diaphragm, a great pressure difference exists between the pressure in the lubricating oil conduit system and the pressure in the by-pass conduit branch. Consequently, the effect of a further pressure drop in the by-pass conduit branch due, for example, to a leak in the conduit system, would have a minor influence on the pressure remaining in the sealed or secured lubricating conduit system. Such minor influence on the pressure in the oil conduit system would not provide an immediate threshhold response for the monitoring system to indicate that pressure in the conduit system has fallen below the predetermined minimum. Consequently, a forced shut down of the internal combustion engine would only be effected once an amount of lubricating oil in the lubricating oil conduit system has been lost by the leak or the like so that the lubricating oil pump is no longer capable of maintaining a minimum lubricating oil pressure. However, at this point in time, considerable damage may have already occurred in the internal combustion engine due to a dry running of the critical lubricating points.

The present invention is concerned with the task to provide a structurally simple lubricating system for a drive mechanism such as an internal combustion engine which operates reliably also in case of the occurrence of small leaks in the lubricating system while eliminating the afore-mentioned shortcomings, whereby the drive mechanism is protected from extensive bearing damage by dry or non-lubricated operation.

According to one advantageous feature of the present invention, a filling pump is arranged in a lubricating system of the drive mechanism, for example, an internal combustion engine, which filling pump constantly replenishes, from a lubricating medium storage tank, a lubricating medium reservoir in a pan of the internal combustion engine with a return pump, having a higher conveying power than the filling pump, being arranged at the internal combustion engine for conveying excess lubricating medium from the pan of the engine back into the storage tank.

According to a further advantageous feature of the present invention, an intake conduit of the return pump has its inlet arranged at the oil pan at a desired level of the lubricating medium with a measuring member, connected to a delivery conduit of the return pump, transmitting a signal upon a failure in the return of the lubricating medium to the storage tank.

Preferably, according to the present invention, a lubricating oil filter is arranged downstream of the measuring member connection in a delivery conduit of the return pump with a warning and/or signalling device being connected to the measuring member by way of a signal line.

By virtue of the above-noted features of the present invention, a non-monitored operation for a drive mechanism such as an internal combustion engine is provided which is virtually free of the normally encountered risks with the duration of the non-monitored operation being solely limited by the capacity of the storage tank.

A warning or signal is emitted in the arrangement of the present invention when any irregularities occur in the lubricating medium supply prior to the existence of a condition at which a lack of lubricating medium endangering the operation of the drive mechanism would normally trigger a monitoring system of the lubricating medium pressure of the drive mechanism, whereby the cause of irregularity in the lubricating medium supply can readily be determined and eliminated prior to the occurrence of any damage to the drive mechanism.

According to further features of the present invention, the measuring member may be fashioned as a flow detector or flow governor or as a pressure detector. If fashioned as a pressure detector, then a pressure monitoring device is arranged in the lubricating medium delivery conduit downstream of the measuring member connection and upstream of a lubricating oil filter.

According to the present invention, the pressure maintaining device in the delivery conduit may be constructed as a spring-loaded valve for a throttle diaphragm arranged in the delivery conduit.

To eliminate short-term conveying fluctuations of the return pump caused by temporary changes in the level of the lubricating medium due to external forces acting upon the drive mechanism, according to the present invention, a delay element is arranged in the signal line between the measuring member and the warning and/or signalling device. Thus, if the drive mechanism is employed to propel, for example, a ship, any adverse movements of the ship due to weather or conditions of the sea, which could cause a temporary change in the level of the lubricating medium, which change would not represent any source of danger for safe lubricating medium supply operation, would be ineffective due to the existence of the delay element.

The advantages attained by the present invention reside particularly in that an operating safety of a drive mechanism such as an internal combustion engine utilized in systems with a continuous non-monitored operation is improved by providing an extensive protection against the occurrence of insufficient lubrication or dry run. Moreover, the danger point in the lubricating medium circulation system previously constituted by a non-monitored by-pass oil filter is eliminated.

Accordingly, it is an object of the present invention to provide a lubricating system for drive mechanisms which avoids by simple means the afore-mentioned shortcomings and drawbacks encountered in the prior art.

A further object of the present invention resides in providing a lubricating system for a drive mechanism which is relatively simple in construction and therefor also relatively inexpensive.

Another object of the present invention resides in providing a lubricating system for a drive mechanism which assures a sufficient lubrication of the drive mechanism under all operating conditions.

A still further object of the present invention resides in providing a lubricating system which minimizes failures or breakdowns due to leaks in the system.

Yet another object of the present invention resides in providing a lubricating system for a drive mechanism which permits a continuous non-monitored operation of the drive mechanism while minimizing, if not avoiding, the possibility of insufficient lubrication of the drive mechanism during such operation.

These and other objects, features and advantages of the present invention will become more apparent from the following description when taken in connection with the accompanying drawing which shows, for the purposes of illustration only, one embodiment in accordance with the present invention, and wherein:

The single FIGURE of the drawing is a schematic illustration of a lubricating system for a drive mechanism in accordance with the present invention.

As shown in the drawing, a drive mechanism, for example, an internal combustion engine 11, which may, for example, form a propulsion unit for a ship or the like, includes a pan 12 for accommodating a lubricating medium such as oil with the amount of lubricating medium being constantly replenished from a storage tank 13 by way of a filling pump 14 arranged at and operatively connected to the internal combustion engine 11. A return pump 15, having a greater conveying capacity than the filling pump 14, is arranged at and operatively connected to the internal combustion engine 11 for constantly conveying any excess lubricating oil from the oil pan 12 back to the storage tank 13.

An intake conduit 16 of the return pump 15 includes an inlet arranged in the oil pan at a height of the desired lubricating oil level. By virtue of the arrangement of the inlet of the intake conduit 16 in such a manner, only that amount of lubricating oil is replenished in each case as has been consumed by the internal combustion engine during its operation.

A measuring member 18 of conventional construction is arranged in a delivery conduit 17 of the return pump 15 and, upon a failure in the return of the lubricating oil, the measuring member transmits an output signal which is fed by way of a signal line 19 to a conventional warning and signalling device 20 which may be of the type emitting an acoustic warning signal, for example, a horn, siren, bell or the like. In lieu of the warning or signalling device 20 or in addition thereto, a conventional optical signalling device 24 such as a light, flag or other indicator may be provided.

The signal line 19 may be an electric line for transmitting pulses or an electric signal to the warning and signalling device 20 and/or 24 or may be a pressure conduit or the like, whereby the signal to the warning and signalling device 20 and/or 24 is effected by way of a pressure medium.

The measuring member 18 may be constructed either as a conventional flow detector such as the type disclosed, for example, in German Pat. No. 1,901,132, or as a conventional pressure detector such as the type disclosed, for example, in German Pat. No. 1,282,769. If the measuring member 18 is a pressure detector, a pressure maintenance device 21, of conventional construction, is arranged in the delivery conduit 17 downstream of the measuring member 18, as viewed in the flow direction from the return pump 15 to the storage tank 13. The pressure maintaining device 21 may be constructed as either a diaphragm-type valve or a spring-loaded valve of conventional construction such as disclosed, for example in German Pat. No. 884,136, or a throttle-type valve such as disclosed, for example, in German Pat. No. 1,949,198.

A lubricating oil filter 22 is arranged in the delivery conduit 17 downstream of the measuring member 18 and/or the pressure maintaining device 21, as viewed in the flow direction from the return pump 15 to the storage tank 13.

To suppress triggering of the warning and signalling device 20 and/or 24 due to fluctuation in the return flow, occurring for short periods of time, occasioned by temporary changes in the lubricating oil level due to external forces acting upon the drive mechanism, a delay element 23 is arranged in the signal line 19 between the measuring member 18 and the warning and signalling device 20 and/or 24. Consequently, if the lubricating system of the present invention is utilized in a drive mechanism which functions as a propulsion unit for a ship, external forces acting upon the ship due to weather or sea conditions resulting in movements of the ship so as to temporarily change the lubricating oil level, will not result in a triggering of the warning and signalling device 20 and/or 24 if such temporary changes occur only for a short period of time.

The delay element 23 may be a mechanically actuated timing relay such as, for example, timing relay Models ZR 706 and C 411 available from Firma BBC and Company, Mannheim, Germany, with the latter model being of the type having a delayed attraction or actuation. In such construction, the response pulse of the delay element 23 is triggered or actuated by, for example, an electric switch of the measuring member 18 and an alarm signal is triggered only if the response pulse has a duration which is longer than the delay of the delay element 23.

A lubricating oil pressure pump 26 is arranged at and operatively connected with the internal combustion engine whereby lubricating oil is drawn from the oil pan 12 by way of a conduit system 27 and directed to schematically illustrated lubricating points 25 of the internal combustion engine.

To protect the drive mechanism from damage due to a failure in the lubricating oil pressure system from the pump 26 to the lubricating points 25, a monitoring system including a measuring member 18', delay element 23', signal line 19', warning or signalling device 20' and/or conventional optical signalling device 24', such as described hereinabove, may be arranged in the conduit system 27. Specifically, a measuring member constructed as a conventional flow detector or pressure detector may be arranged in the delivery conduit system 27, which measuring member would provide a signal either directly or through a delay element such as delay element 23 to a signalling and warning device such as the signalling and warning device 20 and/or 24. As noted above, if the measuring member is constructed as a pressure detector, a pressure maintaining device such as the device 21 may be interposed in the conduit system 27 between the measuring member and the lubricating oil pressure pump 26.

While we have shown and described specific features for carrying out the present invention, it is understood that the same is not limited thereto, but is susceptible of numerous changes and modifications as known to those skilled in the art, and we therefor do not wish to be limited to the details shown and described herein, but intend to cover all such changes and modifications as are encompassed by the scope of the appended claims.

We claim:

1. A lubricating system for a drive mechanism, the system including a lubricating medium storage tank means and an oil reservoir means arranged at the drive mechanism for accommodating a predetermined quantity of lubricating medium, the improvement comprising:

a first pump means arranged at the drive mechanism and operatively connected with the storage tank means and the reservoir means for constantly replenishing the oil reservoir means with a supply of lubricating medium to maintain the predetermined quantity therein during an operation of the drive mechanism, a second pump means arranged at the drive mechanism having a higher conveying power than said first pump means and operatively connected to the oil reservoir means and the storage tank means for conveying excess lubricating medium from the reservoir means to the storage tank means, means arranged in a delivery conduit of said second pump means for monitoring a condition of the lubricating medium and for providing an output signal upon a failure in a return flow of the lubricating medium, and means responsive to the output signal of said monitoring means for providing a warning signal of the failure in the return flow of the lubricating medium.

2. A system according to claim 1, wherein a delay means is interposed between said warning signal means and said monitoring means for delaying an activation of the warning signal means to compensate for short periods of fluctuation in the return flow of the lubricating medium occasioned by external forces acting upon the drive mechanism.

3. A system according to claim 1, wherein said monitoring means includes a means for detecting a flow of the lubricating medium in the delivery conduit of said second pump means.

4. A system according to claim 1, wherein said monitoring means includes a means for detecting a pressure in the delivery conduit of said second pump means.

5. A system according to claim 1, wherein a third pump means is arranged at the drive mechanism for conveying lubricating medium from the reservoir means to lubricating points of the drive mechanism including lubricating medium conduit means, and wherein means are arranged in the conduit means for monitoring an operative condition of said third pump means and for providing a signal indicative of a failure of said third pump means.

6. A system according to claim 1, wherein said second pump means includes an intake conduit means having an inlet opening arranged in the oil reservoir means at a height corresponding to a desired lubricating level for an operation of the drive mechanism, which desired lubricating level is determined by the predetermined quantity of lubricating medium in the reservoir means.

7. A system according to claim 6, wherein a delay means is interposed between said warning signal means and said monitoring means for delaying an activation of the warning signal means to compensate for short periods of fluctuation in the return flow of the lubricating medium occasioned by external forces acting upon the drive mechanism.

8. A system according to claim 7, wherein said monitoring means includes a means for detecting a flow of the lubricating medium in the delivery conduit of said second pump means.

9. A system according to claim 7, wherein said monitoring means includes a means for detecting a pressure in the delivery conduit of said second pump means.

10. A system according to claim 6, wherein a lubricating medium filter means is arranged in a delivery conduit of said second pump means between said monitoring means and the storage tank means.

11. A system according to claim 10, wherein the drive mechanism includes an internal combustion engine.

12. A system according to claim 10, wherein said monitoring means includes a means for detecting a flow of the lubricating medium in the delivery conduit of said second pump means.

13. A system according to claim 12, wherein a delay means is interposed between said warning signal means and said monitoring means for delaying an activation of the warning signal means to compensate for short periods of fluctuation in the return flow of the lubricating medium occasioned by external forces acting upon the drive mechanism.

14. A system according to claim 13, wherein a third pump means is arranged at the drive mechanism for conveying lubricating medium from the reservoir means to lubricating points of the drive mechanism including lubricating medium conduit means, and wherein means are arranged in the conduit means for monitoring an operative condition of said third pump means and for providing a signal indicative of a failure of said third pump means.

15. A system according to claim 13, wherein said warning signal means is constructed so as to provide at least one of an audible and visual warning.

16. A system according to claim 13, wherein said warning signal means is constructed so as to provide both an audible and visual warning.

17. A system according to claim 10, wherein said monitoring means includes a means for detecting a pressure in the delivery conduit of said second pump means.

18. A system according to claim 17, wherein means for maintaining a predetermined pressure are arranged in the delivery conduit of said second pump means downstream of the monitoring means and upstream of the lubricating medium filter means.

19. A system according to claim 18, wherein said pressure maintaining means includes a spring-loaded valve means arranged in the delivery conduit of said second pump means.

20. A system according to claim 18, wherein said pressure maintaining means includes a throttle diaphragm means arranged in the delivery conduit of said second pump means.

21. A system according to claim 20, wherein a delay means is interposed between said warning signal means and said monitoring means for delaying an activation of the warning signal means to compensate for short periods of fluctuation in the return flow of the lubricating medium occasioned by external forces acting upon the drive mechanism.

22. A system according to claim 21, wherein a third pump means is arranged at the drive mechanism for conveying lubricating medium from the reservoir means to lubricating points of the drive mechanism including lubricating medium conduit means, and wherein means are arranged in the conduit means for monitoring an operative condition of said third pump means and for providing a signal indicative of a failure of said third pump means.

23. A system according to claim 21, wherein said warning signal means is constructed so as to provide at least one of an audible and visual warning.

24. A system according to claim 21, wherein said warning signal means is constructed so as to provide both an audible and visual warning.

* * * * *